United States Patent [19]

Doering

[11] 4,120,341

[45] Oct. 17, 1978

[54] GREENHOUSE DOOR ASSEMBLY

[75] Inventor: John Peter Doering, Salinas, Calif.

[73] Assignee: Union Carbide Corporation, New York, N.Y.

[21] Appl. No.: 831,073

[22] Filed: Sep. 7, 1977

[51] Int. Cl.[2] ..... E05D 15/26

[52] U.S. Cl. ..... 160/213; 160/190

[58] Field of Search ..... 160/188, 190, 193, 207, 160/213

[56] References Cited

U.S. PATENT DOCUMENTS

| | | | |
|---|---|---|---|
| 1,451,619 | 4/1923 | Latrace | 160/207 X |
| 2,523,929 | 9/1950 | Taylor | 160/190 |
| 2,936,830 | 5/1960 | Mosher | 160/188 |
| 3,289,740 | 12/1966 | Heier, Jr. | 160/188 |
| 4,026,343 | 5/1977 | James | 160/207 X |

*Primary Examiner*—Kenneth Downey
*Attorney, Agent, or Firm*—J. Hart Evans

[57] ABSTRACT

A door assembly suitable for relatively large openings such as greenhouse ends which comprises upper and lower door panels hinged together at the middle of the door with the upper panel hinged to the upper door frame. The door is counter-weighted and can readily be raised and lowered, even under windy conditions.

9 Claims, 3 Drawing Figures

GREENHOUSE DOOR ASSEMBLY

In certain types of large buildings designed for specilized functions it becomes desirable to be able to open up one end of the building entirely for ease of access. Examples of such buildings are airplane hangers and greenhouses. In the case of certain types of greenhouses it is desirable to be able to drive a tractor in one end of the greenhouse and out the other, covering the entire width of the greenhouse from edge to edge with the tractor and the equipment it draws. This necessitates a door which completely clears the end of the building when in the open position.

The types of doors presently available which can give access to the entire end of a building all have built in limitations. Swinging doors are not practical over a width much greater than 12 feet which limits building widths to about 24 feet. A further disadvantage of swinging doors is that they require a large clear space in order to open them which blocks off a large area from passage. They are also notoriously difficult to fasten down and control in strong winds. Normally posts of some type must be provided where the double doors join in the middle in order to make a secure closure of the doors. A removable panel is sometimes used to increase the distance that can be spanned by two swinging doors. This panel, however, usually takes two men to remove and requires a place for storage.

Another type of door which has been used is one which is hinged along its entire top edge and flips up either 90° until it is horizontal or almost 180° until it is nearly vertical. This type of door requires a clearance in front of it equal to its height, normally 7 or 8 feet or more. It creates difficulties in counter balancing and must be strongly reinforced since it is inclined to sag and be flexible in its horizontal position. Guy wires are usually used to prevent sag. Because of the weight required for reinforcing and the excessive height of the door counter balancing the door is difficult, hence door operation is basically unsafe, particularly in windy areas.

A variation of this last door which swings about a horizontal axis is the standard garage door with a linkage at each side instead of a fixed horizontal hinge. Since it does not have a horizontal support at the top edge, it requires even more bracing to overcome sagging in the middle and therefore its span is customarily limited to about 16 feet. Furthermore, it requires horizontal storage space which is not available in curved room structures such as hangers, quonset huts and greenhouses.

Yet another method of closing wide openings is the use of sliding doors. Sliding doors, however, have the disadvantage that either the space can never be completely open or large extensions beyond the building must be made to store the doors. Again there are problems of exposing these large flat areas to the wind and in the case of sliding doors with sealing them when they are closed. Sliding doors usually require some sort of track or guide at the bottom to keep them from swinging and this in turn sometimes interferes with the operation of equipment used in the building and entering and leaving the building.

I have now managed to avoid the difficulties associated with these conventional type of doors in a new door assembly design. This door assembly consists of a door which is hinged at the top to swing upward but is also hinged in the middle so that the full height of the door need not be supported when it is in the horizontal position. The construction of my door assembly can be better understood with reference to the drawings.

Figure 1:
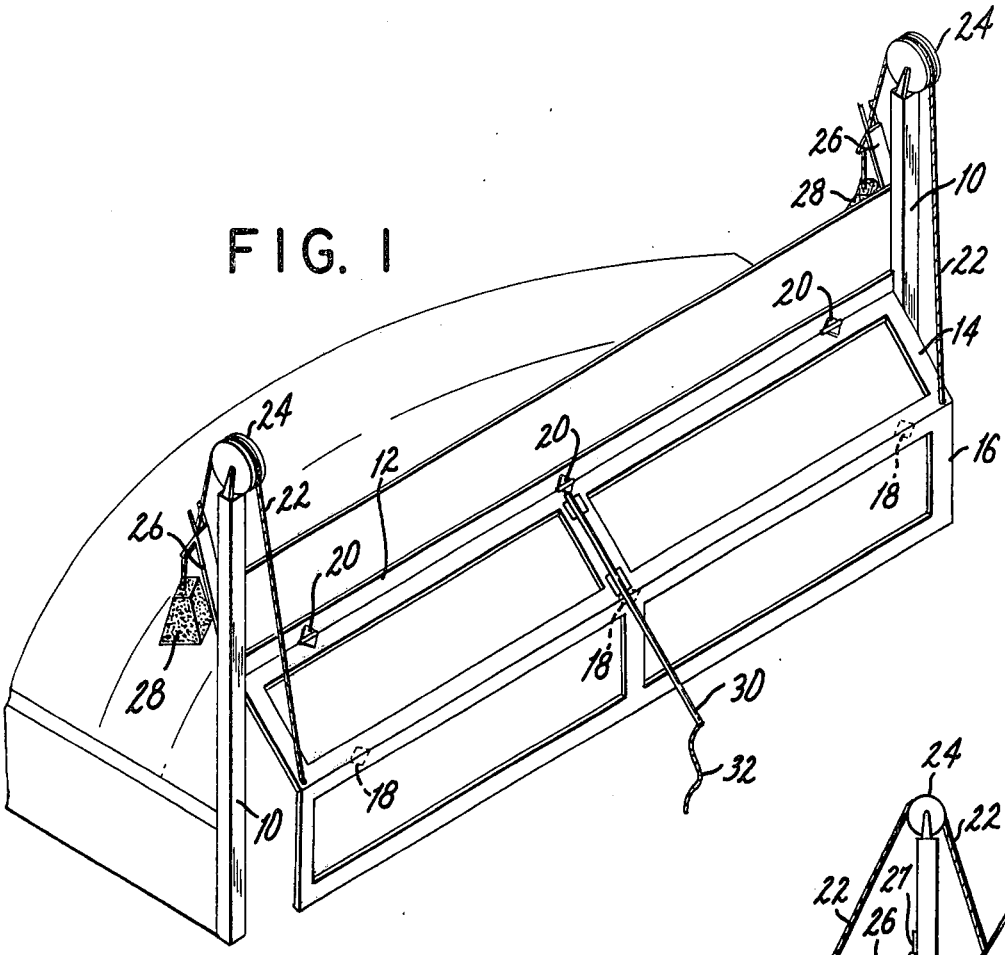
FIG. 1 is an isometric view of one end of a structure such as a greenhouse, the main portion of which is not shown, with a door according to the invention in place.

In FIG. 1 vertical side frame members 10 and a top horizontal frame member 12 define the door opening. The upper door section 14 and lower door section 16 are pivotally connected to one another by edge hinges 18 along their adjacent edges. The upper edge of the upper door section 14 is pivotally attached to the top horizontal frame member 12 by frame hinges 20. Cables 22 are attached at one end to the upper door section 14 at its outer edges near its edge connected to the lower door section 16. The other ends of the cable 22 run over free wheeling pulleys 24 to connect with the outer ends 25 of lever arms 26 pivotally attached to the back sides of the vertical side frame members 10 by pivot hinges 27. The cables 22 extend to the outer ends 25 of the lever arms 26. The counterweights are hung from the outer ends 25 by a connector 38 which may be a separate chain or link or which may be an extension of the cable 22. These counter weights 28 effectively balance the weight of the door panels 14 and 16 so that the door can readily be raised or lowered by hand. Such raising or lowering is facilitated by the extension handle 30 attached to the upper door panel 14 and the trailing rope 32 tied to the end of the extension handle 30.

Figure 2:
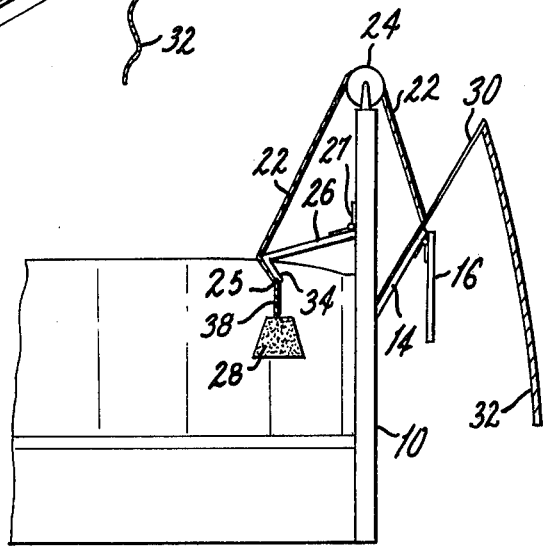
FIG. 2 is a side elevation of the door assembly of FIG. 1, showing the door in an almost fully open position.
Figure 3:
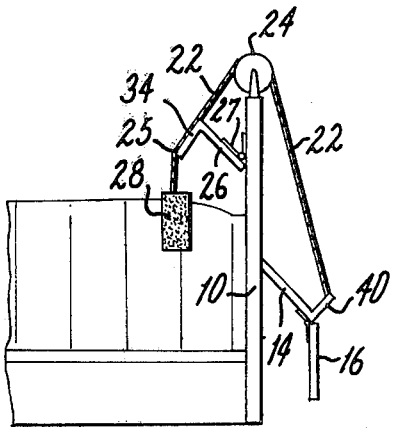
FIG. 3 is a side elevation of a door assembly similar to that of FIG. 1 but having a different attachment of the cable to the door and showing the door in the nearly closed position.

The counter weighting arrangement can be better appreciated in FIG. 2. Shown is the preferred form of the lever arm 26 with a generally "L" shaped configuration, the short leg 34 extending toward the ground. The cable 22 is attached to the lever arm 26 at the outer ends 25. The cable can be trained over the length of short leg 34 fastened at the outer end 25 of short leg 34. A connector 38 connects the outer end 25 to the counterweight 28. In another embodiment the counter weight 28 can be attached directly to the lever arm 26, which may or may not have the short leg 34 omitted, although the "L" shape is preferred. In FIG. 3 is shown the optional extension arm 40 which can be attached to the outer edges of the upper door section 14 at the edge where it is attached to the lower door section 16. The cable arrangement I have devised to counterweight the doors eliminates interference with the building structure which would occur if the counter weights were attached directly to rigid extensions at the edges of the door panel.

Doors, according to my invention, can be made from any suitable material, such as wood, plastic or light weight metal. I have found that for greenhouse doors a wooden frame with plastic film stretched over it is particularly suitable. The framing, however, could be aluminum or magnesium or the like and the covering could be a thin sheet of wood or plastic or even light weight aluminum. Although the material of construction is not critical for most purposes relatively light weight materials will be preferred for the obvious reason that the door is easier to raise and lower and otherwise maneuver if made of light weight material.

Numerous advantages from the construction according to my invention are apparent from a consideration of the drawings. It will be seen that horizontal clearance does not have to be provided for the full height of the door and that the structure required to store the door in a vertical position need not be equal to the full height of the door as in the normal flip up door. Since the door does not extend as far from the hinge point when it is in the horizontal position, the lever arm needed in connection with the counter weight is shorter and less counter balancing is required. The lower half of the door always hangs in the vertical position and being stiff in that plane braces the upper half of the door as it swings through the horizontal thus reducing or eliminating the need for stiffening or bracing.

Further advantages can be seen in the mode of operation of the door. In opening the door the operator stands in a position not beneath is so that if a cable were to break or malfunction, the door would not fall on the operator. Furthermore, the direction of pull and use of the lever arm greatly simplify and ease the task of opening the door. The optional trailing rope 32 in the drawing hangs down when the door is in the open position and can be readily grasped by the operator to pull the door down to the closed position.

The lever arm 26 is essential to the door of my invention. If the cable were connected from the door directly to a vertically operating counter weight without the intervening lever arm then as the door moved through an arc in the operation of opening, the force it would exert on the cable would change, whereas the force of the weight would remain constant. This discrepancy between the two forces would have to be overcome by the operator and in the case of a large door would be a very large force for any one person to attempt to apply. Putting the weight on the hinged lever arm 26 greatly overcomes this discrepancy. If the arm 26 is a straight piece the discrepancy in force still exists to some extent due to the different angles of the cable on each side of the pulley. It is preferred, therefore, to have the lever arm 26 "L" shaped with the short leg 34 pointing downward and the cable trained over the leg 34. By this shaping of the lever arm 26 the forces exerted on the cable by the door and counter weight are more nearly equal throughout their angle of operation thus resulting in relative little force having to be exerted by the operator. Also, the open and closed positions of the door are quite stable so that wind forces do not tend to close the door when it is open for example. Even better equalization of the forces exerted by the door and the counter weight can be achieved by using the preferred through not essential, extension arm 40 on the upper panel of the door to connect to the cable 22. It should be noted also that by varying somewhat the length for the short leg 34 of the lever arm 26 as well as the length of the extension arm 40 it is possible to compensate for varying positions of the lever arm 26 and various lengths of this arm.

What is claimed is:

1. A door assembly suitable for relatively large openings such as an entire greenhouse end and movable between a closed position and an upper open position disposed above the door opening and clear of said opening, comprising:

spaced apart vertical side frame members and a top horizontal frame member defining said door opening, said side frame members extending substantially above said horizontal frame member, upper and lower door sections controlling said door opening, said sections being pivotally connected along their adjacent edges and the upper edge of said upper door section being pivotally attached to said horizontal frame member, cable means attached to upper door section on either side at points proximate to its edge connected to said lower door section, and extending upward to and passing over a pulley means affixed to said vertical side frame members at a height sufficiently above the point of attachment of said upper edge of said upper door section to said horizontal member that said door sections are substantially clear of said door opening when said upper door section is pivoted upward, said cable means then extending down to and being attached to the outer end of lever arms pivotally attached at their inner ends to the back sides of said vertical frame members, counterweights collectively balancing the combined weight of said upper and lower door sections and attached in approximately equal increments to said outer ends of said lever arms.

2. A door assembly according to claim 1 wherein said cable means are attached to said upper door section by means of a short extension arm projecting outward from points on said upper door section proximate to its edge connected to said lower door section.

3. A door assembly according to claim 1 wherein said lever arms attached to said vertical frame members are attached at their outer ends to said counterweights by connecting strands.

4. A door assembly according to claim 3 wherein said connecting strands are extensions of said cables, said cables being attached to said outer ends of said lever arms at points before the ends of said cables, said ends of said cables being attached to said counterweights.

5. A door assembly according to claim 1 wherein said lever arms attached to said vertical frame members are generally "L" shaped, with the short legs of this "L" extending toward the ground with said cable trained over them and said counter weight are at the ends of said short legs.

6. A door assembly according to claim 5 wherein said counterweights are attached to said ends of said short legs by connecting strands.

7. A door assembly according to claim 6 wherein said connecting strands are extensions of said cables, said cables being attached to said ends of said short legs at points before the ends of said cables, said ends of said cables being attached to said counterweights.

8. A door assembly according to claim 1 wherein said upper door section has a handle extending in the plane of said upper door sections beyond the line of pivoted attachment to said lower door section, whereby raising and lowering of said door is facilitated.

9. A door assembly according to claim 1 wherein said cable means are attached to said upper door section by means of a short extension arm projecting outward from points on said upper door section proximate to its edge connected to said lower door section and wherein said lever arms attached to said vertical frame members are generally "L" shaped, with the short legs of this "L" extending toward the ground with said cable trained over them and said counter weight at the ends of said short legs.

* * * * *